US005740823A

United States Patent [19]

Lin et al.

[11] Patent Number: 5,740,823

[45] Date of Patent: Apr. 21, 1998

[54] LIGHTENING SAFETY AUTOMATIC UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 839,492

[22] Filed: Apr. 14, 1997

[51] Int. Cl.[6] ..... A45B 25/14

[52] U.S. Cl. ..... 135/24; 135/22

[58] Field of Search ..... 135/22, 24, 28, 135/23, 20.3, 25.1, 25.3, 25.31, 25.4

[56] References Cited

U.S. PATENT DOCUMENTS

| | | | |
|---|---|---|---|
| 4,941,494 | 7/1990 | Wu | 135/24 X |
| 4,989,625 | 2/1991 | Wu | 135/24 X |
| 5,224,505 | 7/1993 | Wu | 135/24 |
| 5,232,004 | 8/1993 | Wu | 135/24 |
| 5,309,932 | 5/1994 | Chou et al. | 135/22 |
| 5,390,686 | 2/1995 | Lin et al. | 135/24 |
| 5,441,065 | 8/1995 | Lin et al. | 135/24 |
| 5,626,160 | 5/1997 | Ko | 135/24 X |
| 5,645,094 | 7/1997 | Wu | 135/24 |

*Primary Examiner*—Lanna Mai

[57] ABSTRACT

An automatic umbrella includes: a central shaft having a lower tube and an upper tube telescopically engageable with each other, a rib assembly pivotally connected to the central shaft having a lower runner slidably held on the central shaft, an opening spring retained in the central shaft, a control device installed within the grip of the central shaft without protruding any acute portion of the control device for safety purpose, and a drag device including a rod and a rope connected to each other to be retained between a lower portion of the lower tube and the lower runner slidably held on the central shaft, whereby upon actuation of the control device, the upper tube will be extended above the lower tube by the opening spring and the rib assembly may also be upwardly outwardly extended as dragged by the rope and the rod of the drag device for opening the umbrella, with the upper tube slidably telescopically engageable with the lower tube without forming any joint at the coupling location where the upper and lower tubes are slidably coupled, thereby thinning the upper and lower tubes for a lightening umbrella.

1 Claim, 4 Drawing Sheets

LIGHTENING SAFETY AUTOMATIC UMBRELLA

BACKGROUND OF THE INVENTION

A conventional automatic umbrella as shown in FIG. 1 comprises: a central shaft 1 having a lower tube 11 secured with a grip 12 on a lower end of the lower tube 11, an upper tube 13 telescopically engageable with the lower tube 11; a rib assembly 2 having at least a top rib 21 pivotally secured to an upper notch 20 fixed on a top end portion of the central shaft 1, a stretcher rib 22 pivotally connected with the top rib 21 and pivotally secured to a middle runner 24 and a lower runner 23 slidably held on the central shaft 1; an opening spring 3 for opening the umbrella having a lower spring end 31 retained on a spring plug P fixed on a top end of the lower tube 11 and an upper spring end 32 retained at a top end portion of the central shaft 1, an auxiliary tensioning spring 3*a* retained between the lower runner 23 and the middle runner 24 for helping the opening of the umbrella, a pair of balls B resiliently held by a V-shaped spring S in an upper portion of the lower tube 11 for engaging a pair of engaging holes 131 diametrically formed in a lower portion of the upper tube 13; a control means 4 including a push button 41 slidably held in the grip 12, and a catch 42 pivotally secured in the grip 12 by a pivot 421 having a depression portion 420 normally contacting an actuating extension 411 protruding inwardly from the push button 41, a hook portion 422 resiliently protruding outwardly beyond the lower tube 11 as urged by a tension spring 423 for engaging the engaging hook hole formed in the upper tube 13 for locking the umbrella when folded; whereby upon depression of the push button 41 to depress the hook portion 422 and catch 42 inwardly in the central shaft 1 to disengage the hook hole in the upper tube 13, the opening spring 3 and the auxiliary spring 3*a* will extend the upper tube 13 above the lower tube 11 and extend the rib assembly 2 to open the umbrella as shown in FIG. 1 until the engaging holes 131 of the upper tube 13 are engaged with the balls B.

However, this conventional automatic umbrella has the following drawbacks:

1. In order to provide the plug P, the balls B and the spring S in the upper portion of the lower tube 11 for stably extending the upper tube 13 above the lower tube 11 when opening the umbrella, the upper tube 13 and the lower tube 11 should be made of thick metal materials for preventing deformation or breakage of the tubes, thereby increasing the total weight of the umbrella, causing carrying inconvenience and increasing production complexity and cost.

2. If making the upper and lower tubes 13, 11 to be thinner of the tube thickness for decreasing the weight, the thin tubes may not resist larger external force acting upon the central shaft and may cause deformation of the tubes. Meanwhile, the great spring force of the opening spring 3 may accidentally impact the upper tube 13 to be separated from the lower tube 11, thereby easily damaging the umbrella or even injuring the umbrella user.

3. The hook portion 422 of the catch 42 is protruded outwardly beyond the lower tube 11 to possibly injure the user when closing the umbrella.

The present inventors have found the drawbacks of the conventional automatic umbrella, and invented the present lightening and safety automatic umbrella.

SUMMARY OF THE INVENTION

The object of the present invention is to provide an automatic umbrella including: a central shaft having a lower tube and an upper tube telescopically engageable with each other, a rib assembly pivotally connected to the central shaft having a lower runner slidably held on the central shaft, an opening spring retained in the central shaft, a control device installed within the grip of the central shaft without protruding any acute portion of the control device for safety purpose, and a drag device including a rod and a rope connected to each other to be retained between a lower portion of the lower tube and the lower runner slidably held on the central shaft, whereby upon actuation of the control device, the upper tube will be extended above the lower tube by the opening spring and the rib assembly may also be upwardly outwardly extended as dragged by the rope and the rod of the drag device for opening the umbrella, with the upper tube slidably telescopically engageable with the lower tube without forming any joint at the coupling location where the upper and lower tubes are slidably coupled, thereby thinning the upper and lower tubes for a lightening umbrella.

DETAILED DESCRIPTION

Figure 1:
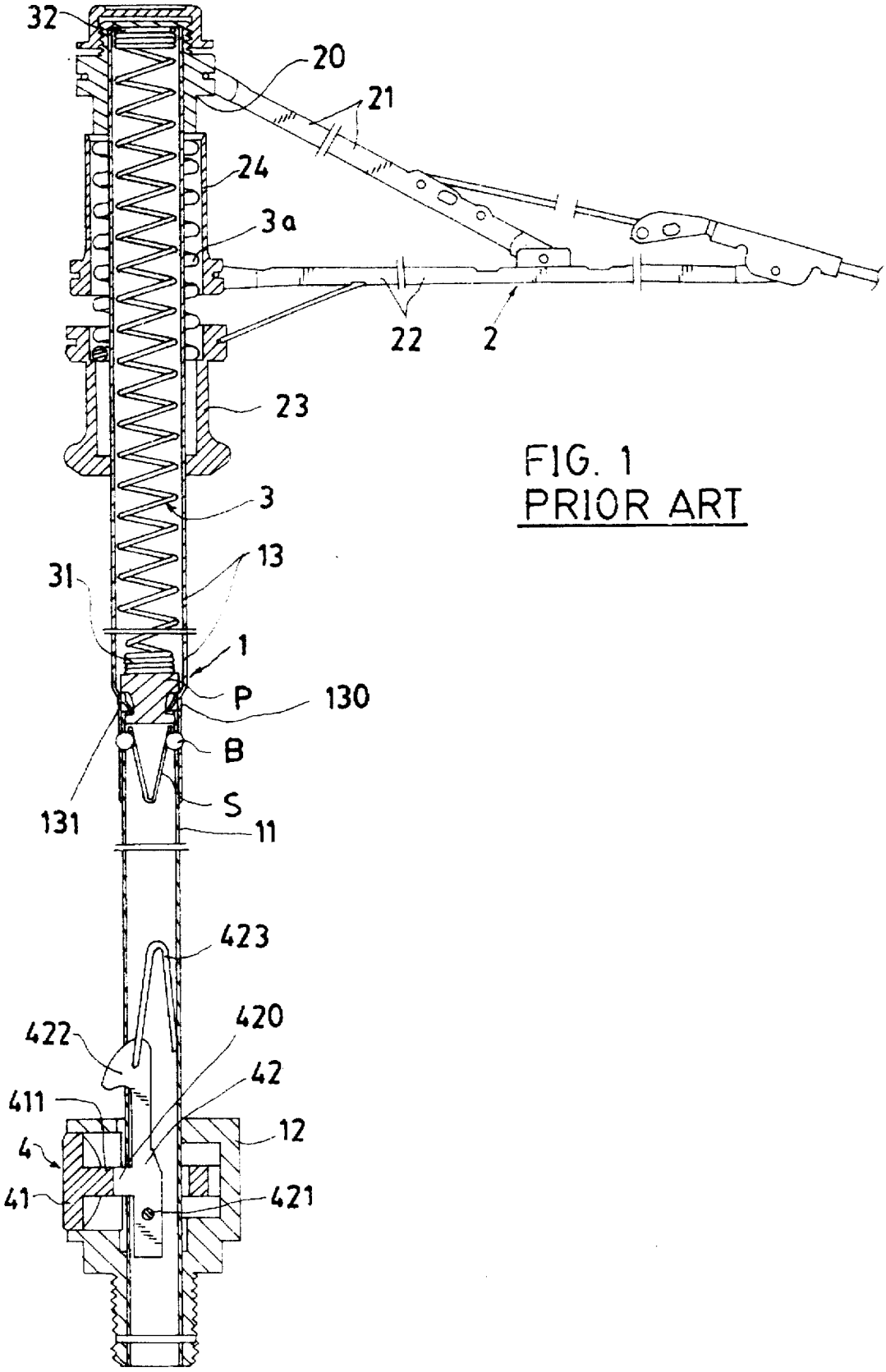
FIG. 1 PRIOR ART
FIG. 1 is a sectional drawing of a conventional automatic umbrella when opened.

As shown in FIGS. 2–7, the automatic umbrella of the present invention comprises: a central shaft 1, a rib assembly 2, an opening spring 3, a control means 4, and a drag means 5. The present invention may be applied for two-fold umbrella, triple-fold or any other multiple folds, not limited.

The central shaft 1 includes: a lower tube 11 having its lower portion 110 connected with a grip 12, an upper end portion 113 of the lower tube 11 telescopically slidably engageable with an upper tube 13, an inner block 14 secured in a top end portion of the upper tube 13, and an inner sleeve 15 secured under the inner block 14 to be slidably disposed within the opening spring 3. The upper tube 13 and the lower tube 11 are slidably engageable without any coupling means provided between the upper portion of the lower tube 11 and the lower portion of the upper tube 13.

The rib assembly 2 includes: at least a top rib 21 pivotally secured to an upper notch 20 fixed on a top end of the central shaft 1, a stretcher rib 22 pivotally connected with the top rib 21 and pivotally secured to a lower runner 23 slidably held on the central shaft 1. The number of the ribs of the rib assembly 2 are not limited.

The opening spring 3 has its lower spring end 31 retained on the plug 52 fixed in a lower portion of the central shaft 1; and an upper spring end 32 retained on the inner block 14 and disposed about an upper sleeve portion 152 of the inner sleeve 15. By inwardly pressing an inward protrusion 112 of the lower tube 11, the plug 52 can be fixed on the inward protrusion 112 of the lower tube 11.

Figure 5:
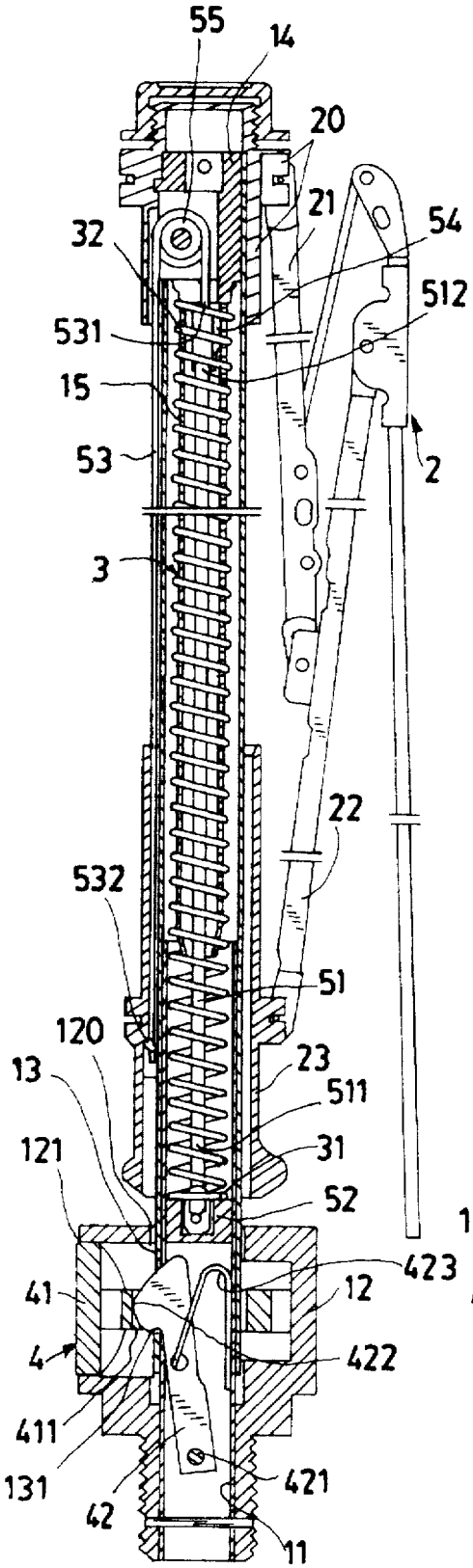
FIG. 5 is a sectional drawing of the present invention when folded.
Figure 6:
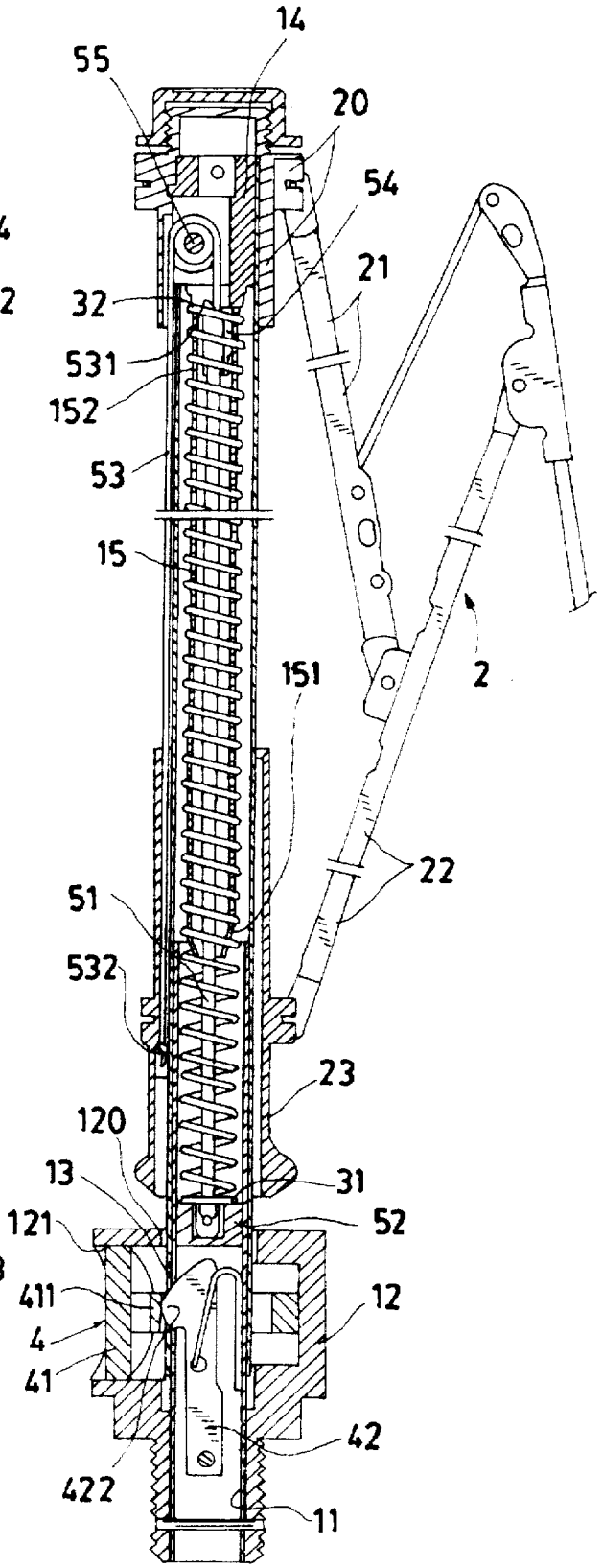
FIG. 6 is an illustration of the present invention when initiated for opening the umbrella.

The control means 4 includes: a push button 41 slidably held in a button hole 121 in the grip 12 having an inward extension 411 protruding inwardly from the push button 41; and a catch 42 pivotally secured in the grip 12 by a pivot 421 having a hook portion 422 protruding outwardly from the catch 42 through a hook hole 111 formed in the lower tube 11 to be engageable with a hook hole 131 formed in a lower portion 130 of the upper tube 13 when folding the umbrella as shown in FIG. 5, and a catch spring 423 retained between the hook portion 422 and an inside wall of a lower portion of the lower tube 11 for normally urging the hook portion 422 outwardly ready for engaging the hook hole 131 of the upper tube 13; with the hook portion 422 facing the inward extension 411 of the push button 41, whereby upon depression of the push button 41 and the inward extension 411, the hook portion 422 will be inwardly depressed to disengage the hook hole 131 of the upper tube 13 for opening the umbrella when opened.

Figures 2, 3, 4, 7:
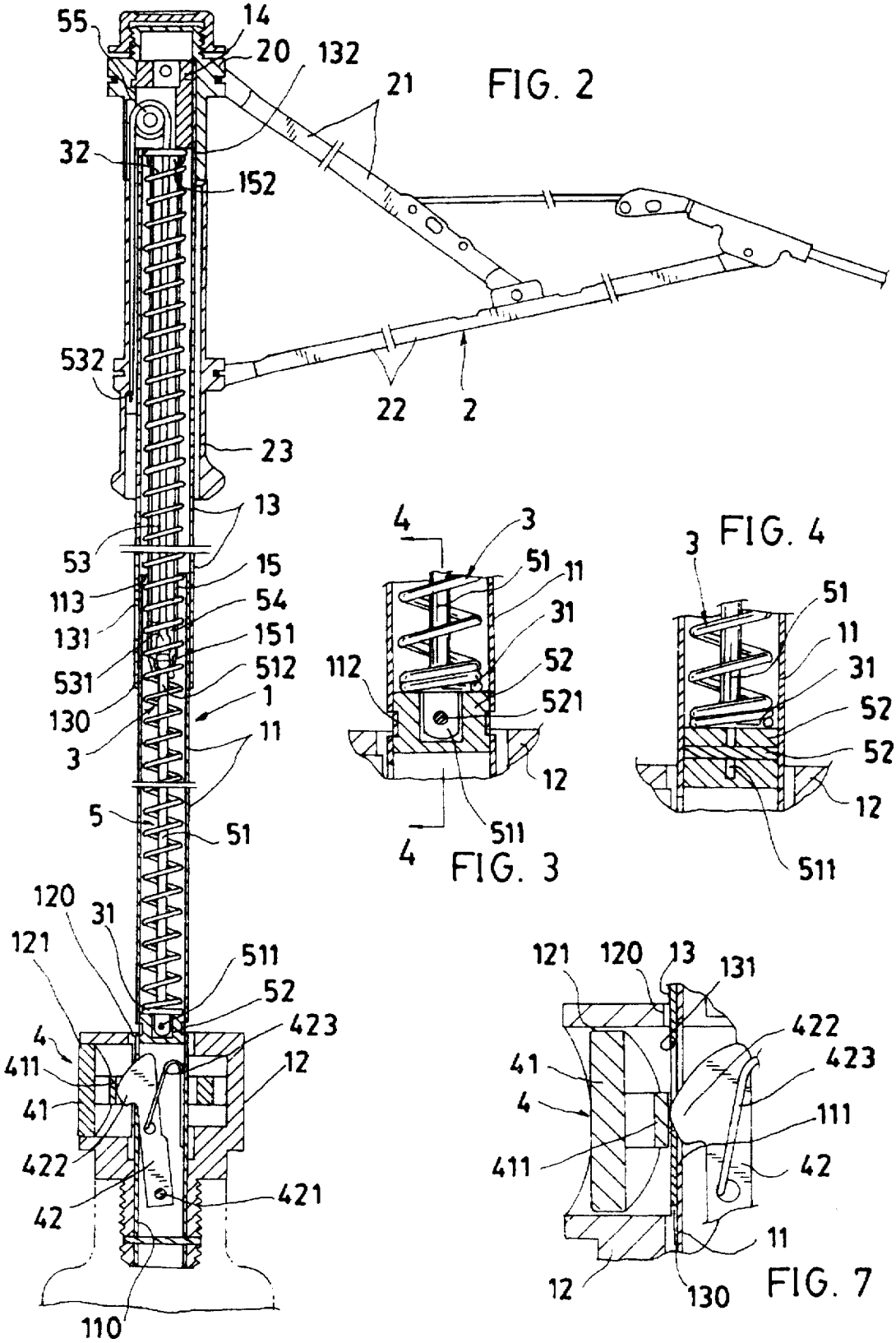
FIG. 2 is a sectional drawing of the present invention when opened.
FIG. 3 is an illustration showing a connection of a plug in a lower portion of the shaft for retaining a lower spring end of the opening spring of the present invention.
FIG. 4 is a sectional drawing as viewed from 4—4 direction of FIG. 3.
FIG. 7 is a partial enlarging illustration of FIG. 6.

The drag means 5 includes: a rod 51 disposed within the opening spring 3 having a lower rod portion 511 secured to the plug 52 by a fixing pin 521; a rope 53 having an inner rope end 531 secured to an upper rod portion 512 by a coupling 54 having a lowermost tapered coupling portion of the coupling 54 to be engageable with a lower sleeve portion 151 of the inner sleeve 15 tapered downwardly when opening the umbrella as shown in FIG. 2; with the rope 53 wound about a roller 55 rotatably mounted in the inner block 112 or in a top portion of the central shaft 1 to allow an outer rope end 532 of the rope 53 to be fixed in the lower runner 23, whereby upon opening of the umbrella, the rope 53 and the rod 51 will be stably extended as tensioned by the opening spring 3 within the central shaft 1.

The grip 12 is formed with a central hole 120 disposed around the central lower portion of the lower tube 11 for poking the lower portion 130 of the upper tube 13 downwardly to engage the hook hole 131 of the upper tube 13 with the hook portion 422 of the catch 42 for folding the umbrella as shown in FIG. 5.

When opening the umbrella of the present invention as shown in FIGS. 5, 6, 7 and 1, the push button 41 is depressed to allow the inward extension 411 to depress the hook portion 422 to be disengaged and unlocked from the hook hole 131 of the upper tube 13, and the resilience of the opening spring 3 will urge the upper tube 13 to raise the upper tube 13 above the lower tube 11 and also extend the ribs of the rib assembly 2 upwardly outwardly for opening the umbrella. Simultaneously, the lower runner 23 is also raised upwardly towards the upper notch 20 as pulled by the rope 53 and the rod 51 resiliently coupled as tensioned by the opening spring 3 to thereby open the rib assembly 2 for opening the umbrella.

When closing the umbrella as shown in FIG. 5, the lower runner 23 is pulled downwardly to engage the hook hole 131 in the upper tube 13 with the hook portion 422 of the catch 42 and the opening spring 3 is also compressed to store its elastic energy ready for next opening of the umbrella when depressing the push button 41.

Even though the present invention is designated as an "automatic" umbrella, however, it should be better called as "semi-automatic" umbrella since the umbrella can not be automatically closed.

The present invention is superior to the automatic umbrella as shown in FIG. 1 with the following advantages:

1. The opening spring 3 is stably retained between the lower portion of the lower tube 11 and the top portion of the upper tube 13. There is no coupling (such as balls and V-shaped spring) provided at the coupling portion between the lower tube and the upper tube. The tubes may thus be made thinner to lighten the tubes of the central shaft 1 such as made of lighter aluminum or aluminum-alloy tubes. The lightening of the tubes of the central shaft 1 may greatly reduce the total weight of the umbrella, thereby being convenient for carrying, storage and uses; and reducing production cost.

2. The easily "derailing" of the balls B from the coupling portion between the upper and lower tubes 13, 11 as shown in FIG. 1 will be prevented since the balls B are eliminated in this invention for a safer mechanism of the automatic umbrella in accordance with the present invention.

3. The hook portion 422 is "built in" the grip portion 12, not protruding outwardly beyond the lower tube 11, to prevent injury to the user to enforce an operation safety of the umbrella.

Figure 8:
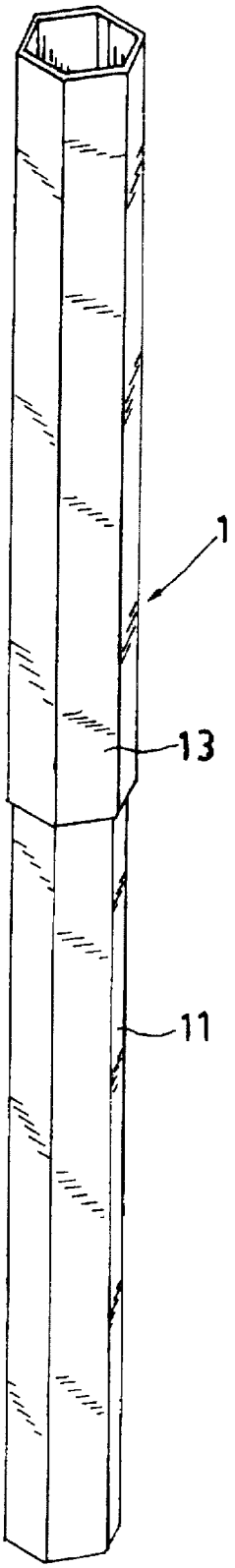
FIG. 8 is an illustration of telescopically engageable lower and upper tubes having cross section of hexagonal shape.
Figure 9:
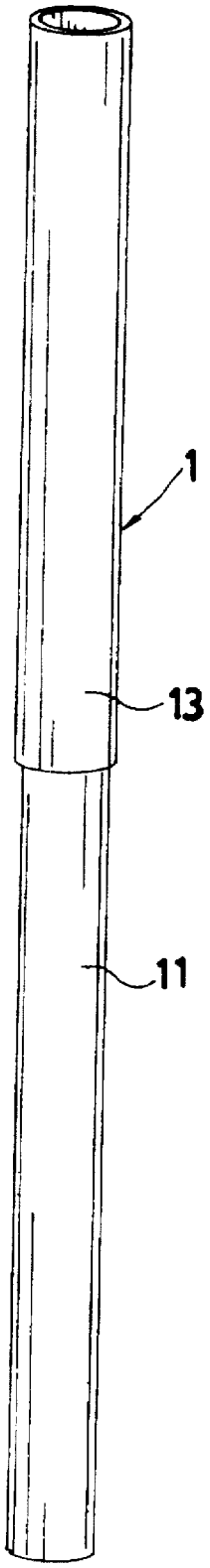
FIG. 9 is an illustration of the tubes of elliptic shape.

The present invention may be modified without departing from the spirit and scope of this invention. The elliptic shape of the tubes as shown in FIG. 9 and the polygonal (hexagonal) shape as shown in FIG. 8 may prevent twisting of the tubes when operating the umbrella.

We claim:

1. An automatic umbrella comprising:

a central shaft having a lower tube, an upper tube including a lower portion of said upper tube telescopically slidably engageable with the lower tube including an upper portion of said lower tube, a grip secured to the lower tube, an inner block secured to a top end portion of the upper shaft and an inner sleeve secured to and protruding downwardly from the inner block;

a rib assembly having at least a top rib pivotally secured to an upper notch fixed on a top end of the central shaft, and a stretcher rib pivotally secured between the top rib and a lower runner slidably held on the central shaft;

an opening spring resiliently retained in said upper tube and said lower tube, having an upper spring end of said opening spring retained on the inner block and disposed about an upper sleeve portion of the inner sleeve;

a control means built in said grip for controlling the opening of the umbrella, said control means including:

a push button slidably held in a button hole in the grip having an inward extension protruding inwardly from the push button;

and a catch pivotally secured in the grip having a hook portion protruding outwardly from the catch through the lower tube to be ingageable with a hook hole formed in a lower portion of the upper tube when folding the umbrella, and a catch spring retained between the hook portion and an inside wall of the lower portion of the lower tube for normally urging the hook portion outwardly ready for engaging the hook hole of the upper tube;

with the hook portion facing the inward extension of the push button, whereby upon depression of the push button and the inward extension, the hook portion will be inwardly depressed to disengage the hook hole of the upper tube for opening the umbrella when opened; and a drag means normally retained between a lower portion of said lower tube and said lower runner, and operatively pulled as tensioned by the opening spring for extending the rib assembly when opening the umbrella, said drag means including:

a rod disposed within the opening spring;

a rope having an inner rope end secured to an upper rod portion of said rod by a coupling having a lowermost tapered coupling portion of the coupling engageable with a lower sleeve portion tapered downwardly from the inner sleeve when opening the umbrella;

with the rope wound about a roller rotatably mounted in a top portion of the central shaft to allow an outer rope end of the rope to be fixed in the lower runner, whereby upon opening of the umbrella, the rope and the rod will be stably extended as tensioned by the opening spring within the central shaft;

the improvement which comprises:

said opening spring having a lower spring end retained on a plug which is fixed in a lower portion of the central shaft;

and said rod of said drag means having a lower rod portion secured into said plug by a pin, whereby upon extending of the opening spring to open the umbrella, the upper tube will be extended above, without being separated from, said lower tube as being limited by said lower rod portion in said plug and in said lower tube.

* * * * *